US006564966B2

(12) United States Patent
Kaiga et al.

(10) Patent No.: US 6,564,966 B2
(45) Date of Patent: May 20, 2003

(54) SHEET FEEDING APPARATUS AND SHEET PROCESSING APPARATUS

(75) Inventors: Miho Kaiga, Shizuoka (JP); Takeshi Kubota, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 21 days.

(21) Appl. No.: 09/963,386

(22) Filed: Sep. 27, 2001

(65) Prior Publication Data

US 2002/0038932 A1 Apr. 4, 2002

(30) Foreign Application Priority Data

Sep. 29, 2000 (JP) ..... 2000-300825

(51) Int. Cl.[7] ..... B65H 1/30
(52) U.S. Cl. ..... 221/145
(58) Field of Search ..... 221/145, 241; 399/393, 107

(56) References Cited

U.S. PATENT DOCUMENTS 5,414,492 A 5/1995 Kubota ..... 355/200
5,621,451 A 4/1997 Sugiura et al. ..... 347/112

FOREIGN PATENT DOCUMENTS

JP 1-117137 * 5/1989 ..... B65H/01/30
JP 4-272060 * 9/1992 ..... B65H/31/40

* cited by examiner

*Primary Examiner*—Donald P. Walsh
*Assistant Examiner*—Kenneth W Bower
(74) *Attorney, Agent, or Firm*—Fitzpatrick, Cella, Harper & Scinto

(57) ABSTRACT

A sheet feeding apparatus and a sheet processing apparatus is provided, in which there are provided in an edge area of an opening 16 a guide groove 12*b* for guiding insertion of a separating pad unit 18 into the opening 16 from the side on which a sheet feeding roller 6 is disposed and a rotation regulating groove 15*c* for regulating a rotation regulating fitting shaped portion 15*a* provided in the separating pad unit 18 to be guided by the guiding groove 12*b* to be inserted in the opening 16 to locate the separating pad unit 18 in a position in the opening 16 where the separating pad unit 18 should be accommodated, whereby a sheet feeding apparatus and a sheet processing apparatus with improvement of usability as well as improvement of sheet feeding performance are realized.

13 Claims, 10 Drawing Sheets

(a)

(b)

(a)

(b)

SHEET FEEDING APPARATUS AND SHEET PROCESSING APPARATUS

BACKGROUND OF THE INVENTION

1. Field of the Invention

The present invention relates to a sheet processing apparatus such as a scanner, a copying machine, a printer or a facsimile apparatus having means for reading an image of an original and/or forming an image on a sheet, and in particular, to a sheet feeding apparatus for feeding a sheet which is provided in these apparatuses.

2. Description of the Related Art

As an example of a conventional sheet processing apparatus of this type, an image reading apparatus is shown in FIGS. 9 and 10.

An image reading apparatus 40 has a configuration in which an upper original guide 46 that is a rotatable upper frame forming an upper part of a main body of the image reading apparatus 40 and a lower original guide 102 that is a fixed lower frame forming a lower part of the main body (hereinafter referred to as conveying frame) are combined and an original conveying path is formed between the upper original guide 46 and the conveying frame 102.

The conveying frame 102 is provided with a sheet feeding roller 103 that receives driving force transmitted from a not-shown motor to feed an original D from an original tray 101 on which a sheaf of originals is stacked to a download side of an original conveying direction, a contact image-reading sensor (hereinafter referred to as CIS) 110 for reading image information on the original D, a conveying roller 107 for conveying the original D to the CIS 110, a discharge roller 109 for discharging the original D, and the like. In addition, a separating pad 105 for coming into contact with the sheet feeding roller 103 to separate originals one by one from the sheaf of originals, a conveying roller 106 for into contact with the conveying roller 107 to convey the original D to the CIS 110, a discharge roller 108 for coming into contact with the discharge roller 109 to discharge the original D to a discharge port 114, and the like are arranged on the upper original guide 46.

A plurality of pieces of originals D set with their reading surfaces facing downward on the original tray 101 are separated and conveyed one by one from the one at the bottom by the sheet feeding roller 103 and the separating pad 105. The separated original D is conveyed to the CIS 110 by the conveying roller 107 and the conveying roller 106. When the original D passes the CIS 110, an image is read and the original D from which the image is read is discharged to the original discharge port 114 by the discharging roller 109 and the discharging roller 108.

The separating pad 105 is held by a pad holder 31, which is attached to the upper original guide 46. The pad holder 31 is rotatable and configured to come to be in pressured contact with the sheet feeding roller 103 by a coil spring 51 at a predetermined pressure.

FIGS. 10(*a*) and 10(*b*) are views showing the back of the upper original guide that is removed from the image reading apparatus. A method of attaching the pad holder 31 holding the separating pad 105 to the upper original guide 46 will be described with reference to FIG. 10. An opening 47 for embedding the pad holder 31 is formed in the center of the upper original guide 46.

Shaft fitting portions 48 and 49, in which outer portions of rotating shafts 32 and 33 of the pad holder 31 can be fitted are provided on both side portions of the opening 47 on the back of the upper original guide 46.

The shafts 32 and 33 are fitted in the shaft fitting portions 48 and 49 from the back of the upper original guide 46, whereby the pad holder 31 is attached to the upper original guide 46.

However, in the case of the above-mentioned prior art, there are problems as described below, A separating pad unit (a unit incorporating separating means consisting of the separating pad 105 and the pad holder 31) is attached from the back of the upper original guide 46 in a state in which the back of the upper original guide 46 is opened by removing an armor attached to the upper original guide 46. Thus, it is difficult to insert the separating pad unit and a worn separating pad unit is poorly replaceable.

The present invention has been devised in view of the above and other drawbacks of the prior art, and it is an object of the present invention to provide a sheet feeding apparatus and a sheet processing apparatus in which improvement of usability as well as improvement of sheet feeding performance are realized.

SUMMARY OF THE INVENTION

In order to attain the above-mentioned object, the present invention provides a sheet feeding apparatus that is comprising

- a sheet conveying rotational member that is rotated in a feeding direction of sheets;
- a separating unit having a frictional member for abutting the sheet conveying rotational member to form a nip portion; and
- a frame body having an opening in which the separating unit is accommodated and holding the separating unit,
- wherein said sheets can be separated and fed one by one by the nip portion, and
- which is characterized in that an insertion guide for guiding insertion of the separating unit into the opening from the sheet conveying rotational member side; and
- a position regulating portion provided in the edge area of the opening and regulating a portion to be regulated, which is provided in the separating unit guided by the insertion guide to be inserted in the opening, to locate the separating unit in a position inside the opening where the separating unit should be accommodated are provided in an edge area of the opening.

DETAILED DESCRIPTION OF THE PREFERRED EMBODIMENTS

Preferred embodiments of the present invention will be hereinafter illustratively described in detail with reference to drawings. Further, dimensions, materials and shapes of components and their relative arrangements described in the embodiments should be properly changed according to a configuration and various conditions of an apparatus to which the present invention is applied and are not intended to limit the scope of the present invention to the following embodiments.

First Embodiment

Figure 1:
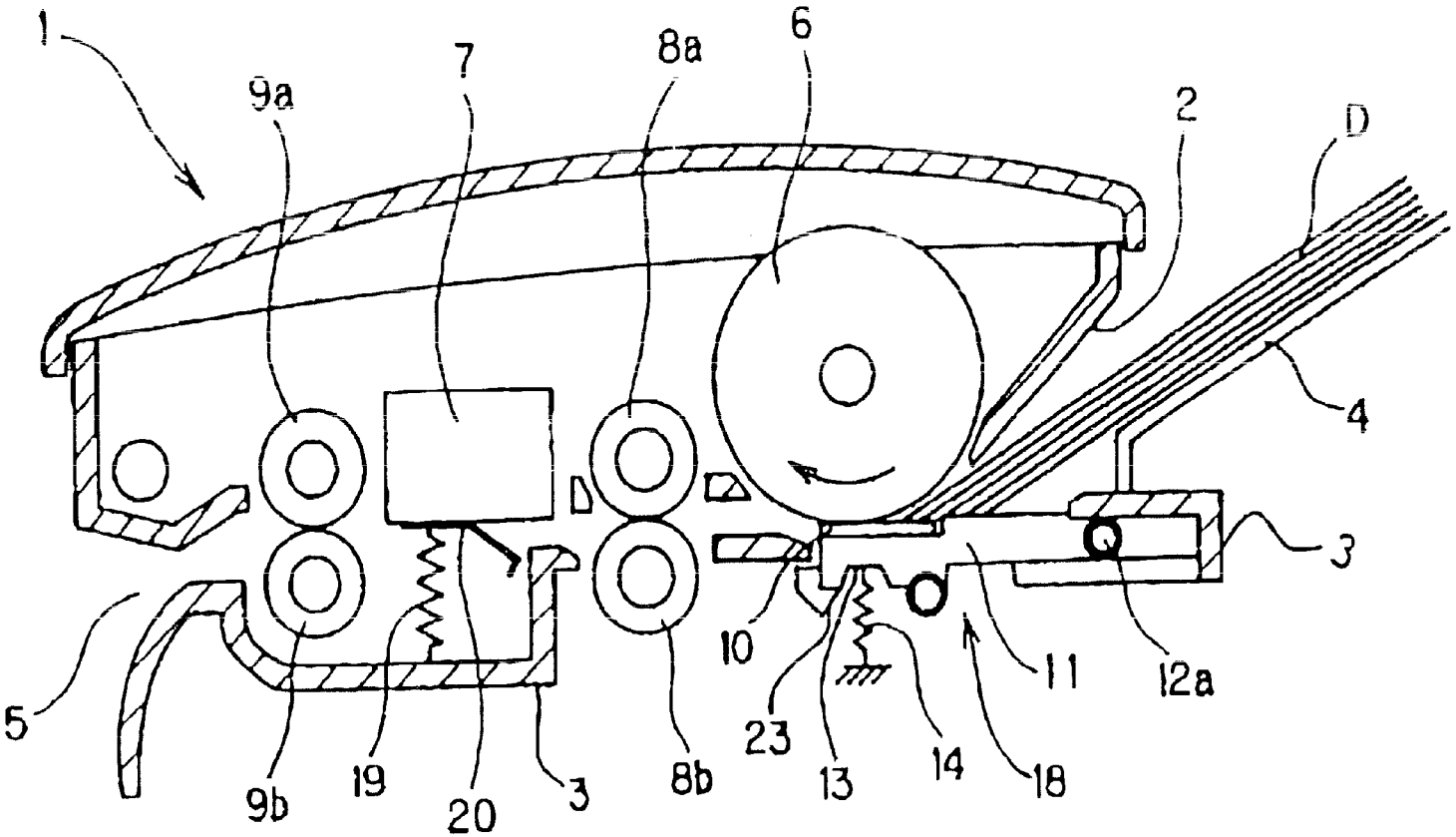
FIG. 1 is a schematic sectional view of an image reading apparatus according to a first embodiment.

FIG. 1 is a schematic sectional view showing a configuration of an image reading apparatus as a sheet processing apparatus provided with a sheet feeding apparatus in accordance with a first embodiment.

An image reading apparatus 1 has a configuration in which a rotational upper original guide 2 that is an upper frame forming an upper part of a main body of the image reading apparatus 1 and a fixed lower original guide 3 (hereinafter referred to as conveying frame) as a frame body which is a lower frame forming a lower part of the main body are combined and an original conveying path as a sheet conveying path is formed between the rotational upper original guide 2 and the fixed conveying frame 3.

The upper original guide 2 is provided with a sheet feeding roller 6 as a sheet conveying rotational member for feeding an original D from an original tray 4 on which a sheat of originals is stacked to a discharge port 5 on a download side of an original conveying direction, a contact image-reading sensor (hereinafter referred to as CIS) 7 as image reading means for reading image information on the original D, a conveying roller 8*a* for conveying the original D to the CIS 7, a discharge roller 9*a* for discharging the original D to a discharge port 5, and the like. In addition, a separating pad 10 as a frictional member for coming into contact with the sheet feeding roller 6 at a nip portion to separate originals one by one, a conveying roller 8*b* for coming into contact with the conveying roller 8*a* to convey the original D to the CIS 7, a discharge roller 9*b* for coming into contact with the discharge roller 9*a* to discharge the original D to the discharge port 5, and the like are arranged on the conveying frame 3. Reference numeral 20 denotes a white plate for pressing and making the original D to closely contact the CIS 7 by a coil spring 19.

A plurality of pieces of originals D set with their reading surfaces facing upward on the original tray 4 of the image reading apparatus 1 are separated and conveyed one by one from the one at the top by the sheet feeding roller 6 and the separating pad 10. The separated original D is conveyed to the CIS 7 by the conveying roller 8*a* and the conveying roller 8*b*. When the original D passes the CIS 7, an image is read and the original D from which the image is read is discharged to the original discharge port 5 by the discharging roller 9a and the discharging roller 9*b*.

The separating pad 10 is held by a pad holder 11, which is configured to perform a rotating motion with a rotational shaft 12*a* as a fulcrum and apply a predetermined pressure to the sheet feeding roller 6 by pressuring a pressure receiving portion 13 on a back of a tip on a conveying downstream side of the pad holder 11 by pressuring means 14.

A separating unit consisting of the separating pad 10 and the pad holder 11 is hereinafter referred to collectively as a separating pad unit 18.

Figure 2:
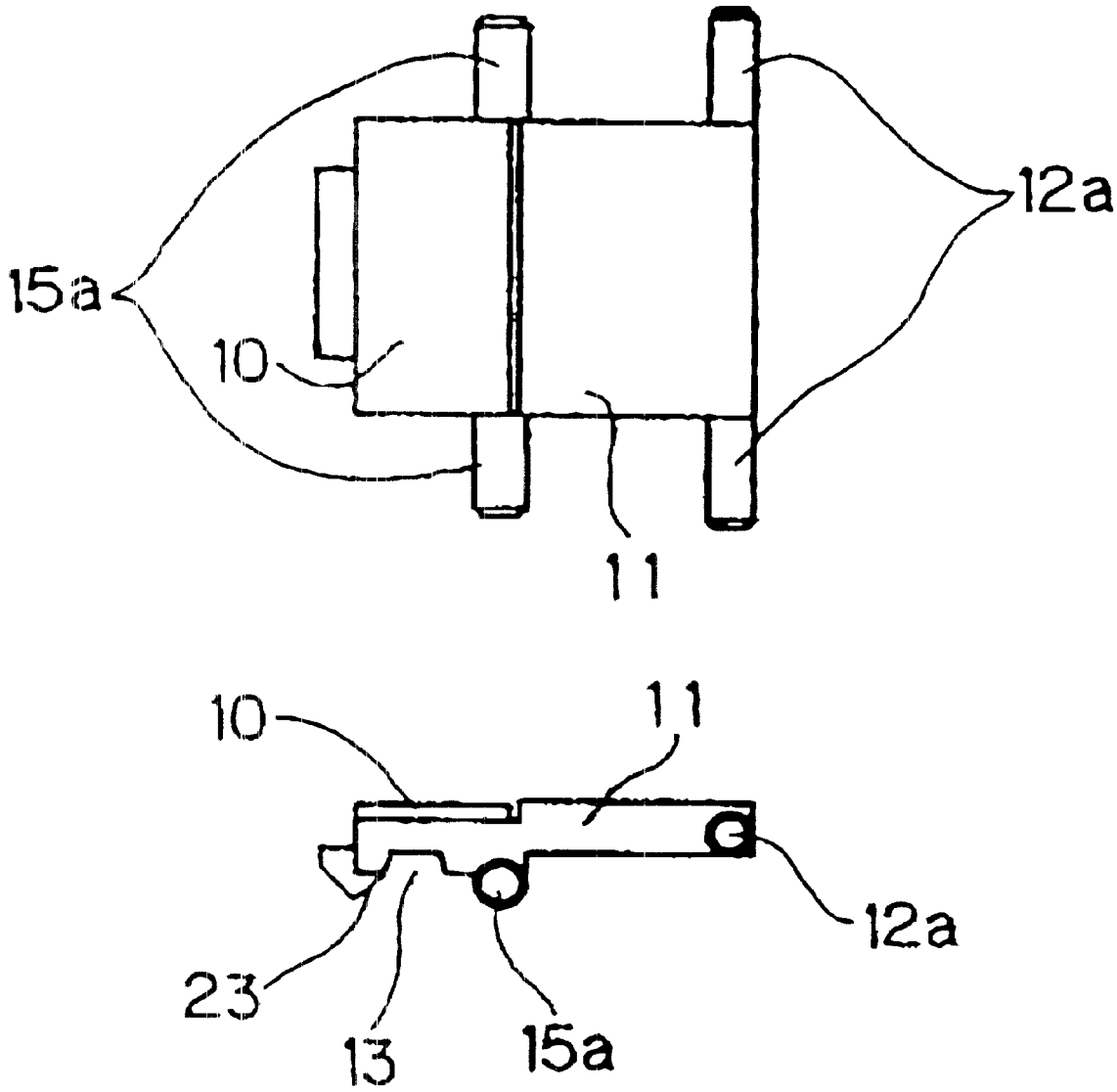
FIG. 2 is detailed explanatory views of separating means of a sheet feeding portion in accordance with the first embodiment.
Figure 3:
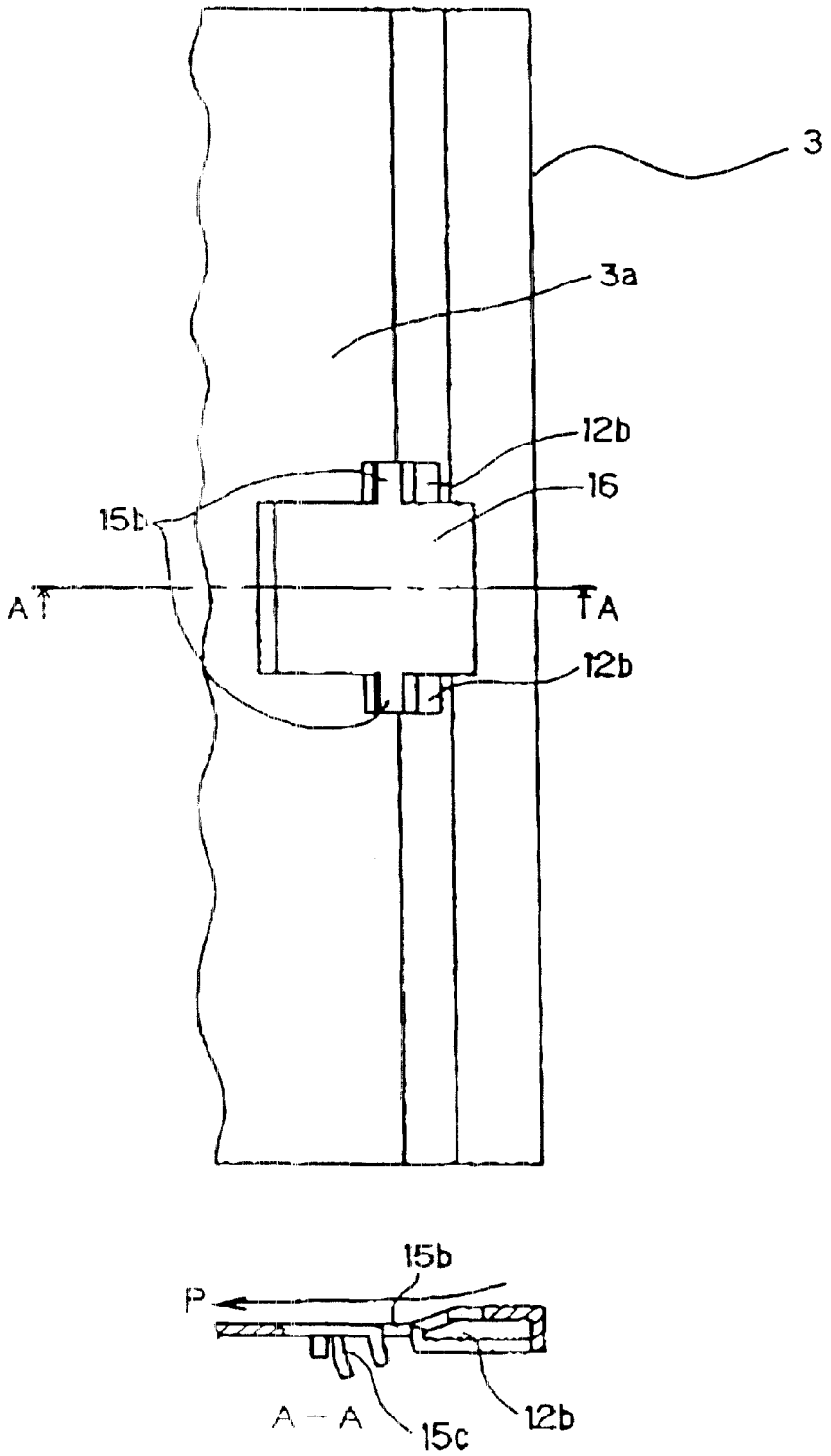
FIG. 3 is detailed explanatory views of a separating means mounting portion of a housing in accordance with the first embodiment.

Next, details of the separating pad unit 18 in accordance with this embodiment will be described with reference to FIGS. 2 and 3.

The separating pad unit 18 has a rotational shaft 12*a* for forming a rotational center of the pad holder 11 in the upstream in a conveying direction of the pad holder 11 in a direction perpendicular to the conveying direction, has a rotation regulating fitting shaped portion 15*a* for regulating a rotating track motion in the vicinity of the downstream side in the conveying direction of the pad holder 11 in a direction perpendicular to the conveying direction, and has a pressuring means receiving portion 13 for receiving a pressure from the pressuring means 14 in a fixed direction on the back side of the side on which the separating pad 10 is disposed in the end on the downstream side in the conveying direction of the pad holder 11.

In addition, a slanted surface 23 having a slanted shaped portion with a gentle slant to guide insertion of the pressuring means 14 is provided on the downstream side in the conveying direction of the pressuring means receiving portion 13.

The separating pad unit 18 is embedded in the central part of the conveying surface of the conveying frame 3 located on a side opposing the sheet feeding roller 6.

An opening 16 for housing the separating pad unit 18 is provided in the central part on the conveying surface of the conveying frame 3. In addition, a guide groove 12*b* as an insertion guide that is formed to fit with the rotational shaft 12*a* of the pat holder 11 and to make the rotational shaft 12*a* movable in the same direction as the conveying direction is provided on both the sides of the opening on the upstream side in the conveying direction, whereby the rotational shaft 12*a* can be inserted in the guide groove 12*b* from the conveying surface.

A through hole 15*b* for inserting the rotation regulating fitting shaped portion 15*a* as a portion to be regulated provided in the pad holder 11 into the back of the conveying frame 3 and a rotation regulating groove 15*c* as a position regulating portion for fitting with the rotation regulating fitting shaped portion 15*a* to regulate a rotating motion of the separating pad unit 18 and locate the separating pad unit 18 in a position in the opening 16 where it should be accommodated a reformed on both the sides on the downstream side in the conveying direction in the edge area of the opening 16. In addition, the coil spring 14 being the pressuring means of the pad holder 11 is disposed and formed in a bridge shape in the downstream part in the conveying direction of the opening of the conveying frame 3. Thus, miniaturization (thickness reduction) of the apparatus is readily realized.

The separating pad unit 18 is pressed by the coil spring 14 on the pressuring means receiving portion 13 of the pad holder 11, thereby bringing the separating pad 10 to be in pressured contact with the sheet feeding roller 6.

The rotating motion of the separating pad unit 18 is regulated by fitting the rotation regulating fitting shaped portion 15*a* of the pad holder 11 in the rotation regulating groove 15*c*.

Figure 4:
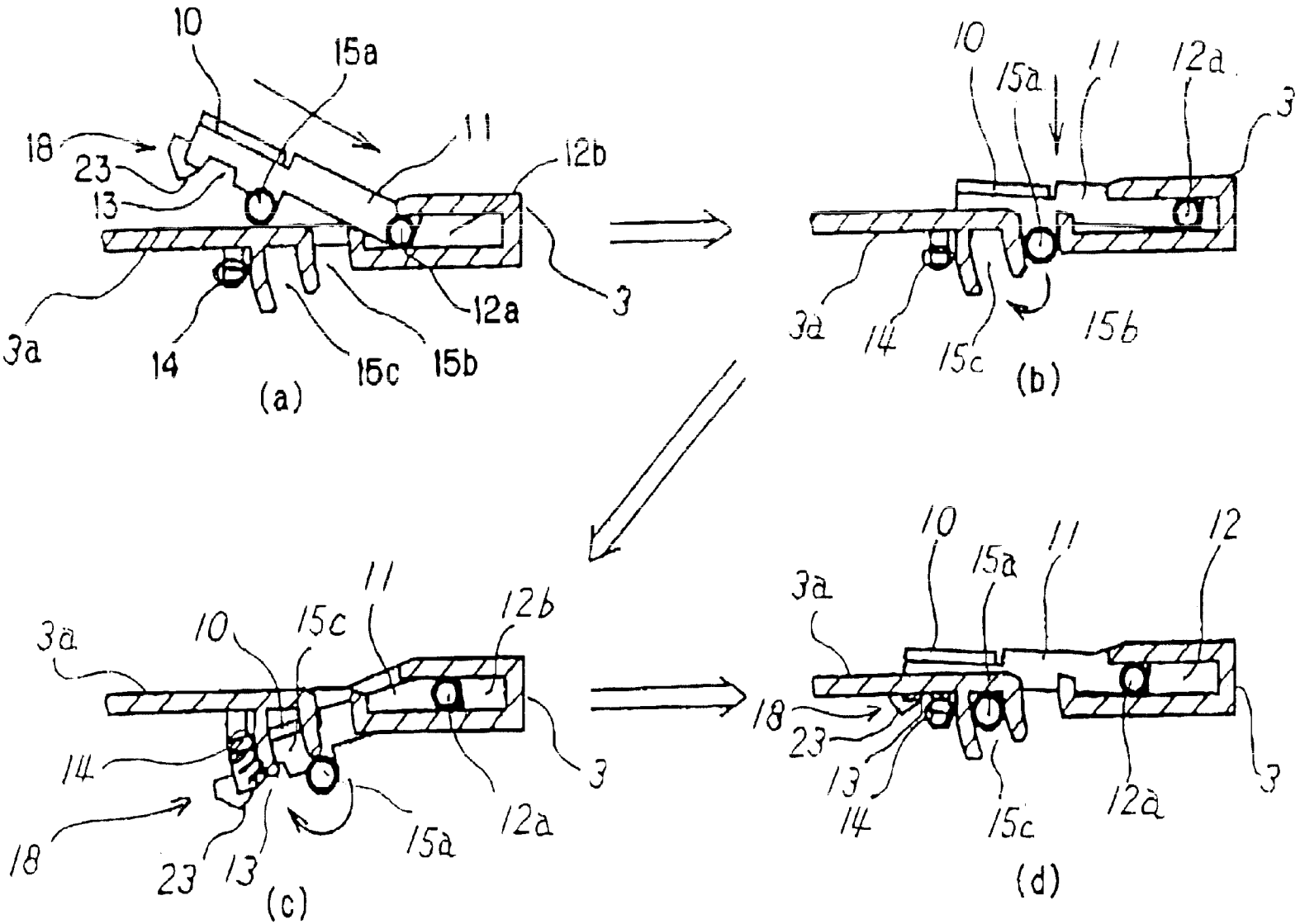
FIG. 4 is explanatory views showing operations for attaching the separating means in accordance with the first embodiment.

Next, a configuration for attaching the separating pad unit 18 to the conveying frame 3 will be described with reference to FIG. 4.

The conveying frame 3 to which the separating pad unit 18 is attached and the upper original guide 2 to which the sheet feeding roller 6 is attached are combined, whereby the nip between the separating pad 10 and the sheet feeding roller 6 can be opened in dealing with paper jamming or the like.

When the upper original guide 2 is opened and the nip position between the sheet feeding roller 6 and the separating pad 10 is opened, a conveying surface 3*a* and the conveying surface opening 16 can be seen.

(1) Place the separating pad unit 18 in the opening 16 of the central part of the conveying surface from the side on which the sheet feeding roller 6 is disposed to insert the rotating shaft 12*a* into the guide groove 12*b* and then insert the rotation regulating fitting shaped portion 15*a* in the inserting hole 15*b* while sliding the separating pad unit 18 to the upstream side in the conveying direction. (FIG. 4(*a*)), and (2) slide the separating pad unit 18 in the conveying downstream direction while pressing the downstream side portion in the conveying direction of the pat holder 11 to a direction opposite to a pressuring direction (FIGS. 4(*b*) to 4(*c*)), (3) then, the coil spring 14 surmounts the slanted surface 23 while the pad holder 11 receiving a repulsion of the coil spring 14 and the rotation regulating fitting shaped portion 15*a* is disposed in the rotation regulating groove 15*c* (FIG. 4(*d*)).

In order to remove the separating pad unit 18, it is sufficient to perform opposite operations.

When the rotation regulating fitting shaped portion 15*a* is removed from the rotation regulating groove 15*c*, the separating pad unit 18 is lifted to the conveying surface 3*a* by the repulsion generated when the coil spring 14 surmounts the slanted surface 23, whereby the separating pad unit 18 can be removed from the conveying surface 3*a* easily.

As described above, according to this embodiment, since the separating pad unit 18 was attachably detachable from a sheet conveying surface side in two actions, insertion of the separating pad unit 18 could be performed easily and operability was successfully improved. That is, the pad holder 11 being a holding member forming the separating pad unit 18, a structure for supporting the pad holder 11 in a housing and a shape of the housing for supporting the pad holder 11 was simply changed slightly from a conventional configuration, whereby usability was successfully improved without increasing the number of components.

Moreover, since replaceability of the separating pad unit 18 that has ended its durable life was improved, disassembling performance as good as that of new one was able to be easily provided and it became possible to stabilize sheet feeding performance at low costs.

Although the opening 16 of the conveying frame 3 is provided in the central part of the conveying frame in this embodiment, a position of an opening is not limited to a central part in the case in which the arrangement of the sheet feeding roller 6 and the separating pad 10 is not in a center of a reader frame such as the case of a one side standard configuration.

In addition, although the rotation regulating fitting shaped portion 15*a* is formed in a symmetrical shape and disposed to protrude from both the sides of the holding member in this embodiment, it is sufficient that one or more rotation regulating fitting shaped portions 15*a* are disposed as long as they have a configuration for regulating a rotating motion.

Further, the present invention is not limited to the above-mentioned embodiment and, for example, the separating pad may be a fixed roller or a retard roller. In addition, the conveying roller and the sheet feeding roller may be other rotating bodies such as a belt. In addition, the present invention can be applied to an image forming apparatus such as a copying machine and a printer other than the image reading apparatus.

Moreover, the positional relation between the sheet feeding roller 6 to be sheet feeding means and the separating pad unit 18 to be separating means may be reversed.

That is, the sheet feeding roller 6 maybe disposed in a conveying frame on a fixed side and the separating pad unit 18 may be disposed in the upper guide frame 2 on a movable side.

Second Embodiment

Figure 5:
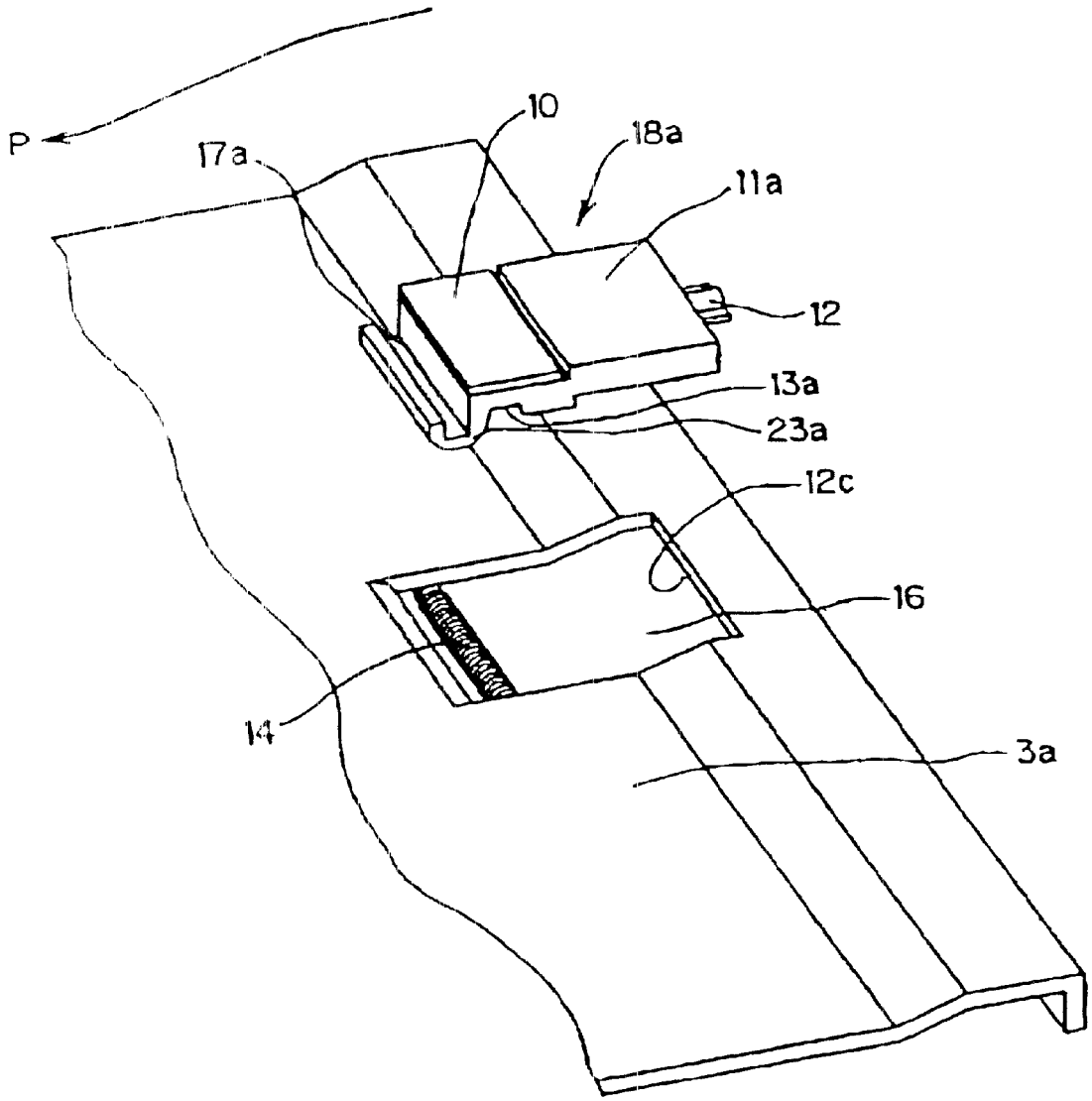
FIG. 5 is detailed explanatory views of a main part of a sheet feeding apparatus in accordance with a second embodiment.
Figure 5:
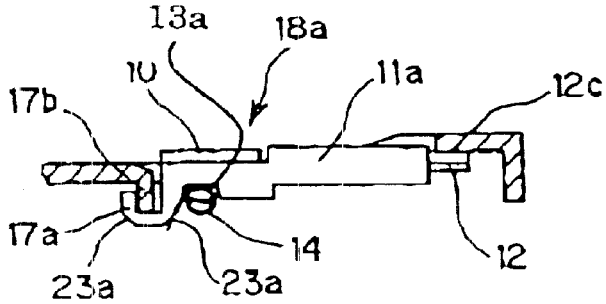

FIG. 5 shows a second embodiment of the present invention. Further, like reference numerals are assigned to components that are similar to or the same as those in the first embodiment and description of them is omitted. A characteristic configuration of this embodiment will be hereinafter described.

A separating pad unit 18*a* has a rotational fulcrum shaped portion 12 for forming a fulcrum of a rotating motion of a pad holder 11*a* on the upstream side in a conveying direction of the pad holder 11*a* in a conveying direction, has a rotation regulating protruded shaped portion 17*a* for regulating a rotating motion on the downstream side in the conveying direction of the pad holder 11*a* in the conveying direction, and has a pressuring means receiving portion 13*a* for receiving a pressure from the pressuring means 14 in a fixed direction on the back side of the side on which the separating pad 10 is disposed in the end in the downstream part in the conveying direction of the pad holder 11*a*.

In addition, a slanted surface 23*a* having a slanted shaped portion with a gentle slant to guide insertion of the pressuring means 14 is provided on both the upstream and the downstream sides in the conveying direction of the pressuring means receiving portion 13*a*.

The separating pad unit 18*a* is embedded in the central part of the conveying surface of the conveying frame 3 located on a side opposing the sheet feeding roller 6.

An opening 16 for housing the separating pad unit 18*a* is provided in the central part of the conveying surface of the conveying frame 3. In addition, a rotation regulating protruded shaped portion 17*b* that is formed to fit with the rotation regulating recessed shaped portion 17*a* in a rotating area of the pat holder 1*a* on the downstream side in the conveying direction of the opening and the coil spring 14 being the pressuring means of the pad holder 11*a* is disposed and configured in a bridge shape in the downstream part in the conveying direction of the opening 16 of the conveying frame 3. Thus, the miniaturization (thickness reduction) of the apparatus is readily realized The separating pad unit 18*a* is pressed downward at the time of original separation. Then, the pressuring means receiving portion 13*a* of the pad holder 11*a* is pressed by the coil spring 14, whereby the separating pad unit 18*a* performs a rotating motion with an arbitrary point of the rotational fulcrum shaped portion 12 as a fulcrum. Simultaneously, the rotation regulating protruded shaped portion 17*b* as a position regulating portion regulates the rotation regulating recessed shaped portion 17*a* as a portion to be regulated, whereby the separating pad 10 is brought to be in pressured contact with the sheet feeding roller 6 in a predetermined direction.

Next, a configuration for attaching the separating pad unit 18*a* to the conveying frame 3 will be described with reference to FIG. 6.

The conveying frame 3 to which the separating pad unit 18*a* is attached and the upper original guide 2 to which the sheet feeding roller 6 is attached are combined, whereby the nip between the separating pad 10 and the sheet feeding roller 6 can be opened in dealing with paper jamming or the like.

When the upper original guide 2 is opened and the nip position between the sheet feeding roller 6 and the separating pad 10 is opened, a conveying surface 3*a* and the conveying surface opening 16 can be seen.

Figure 6:
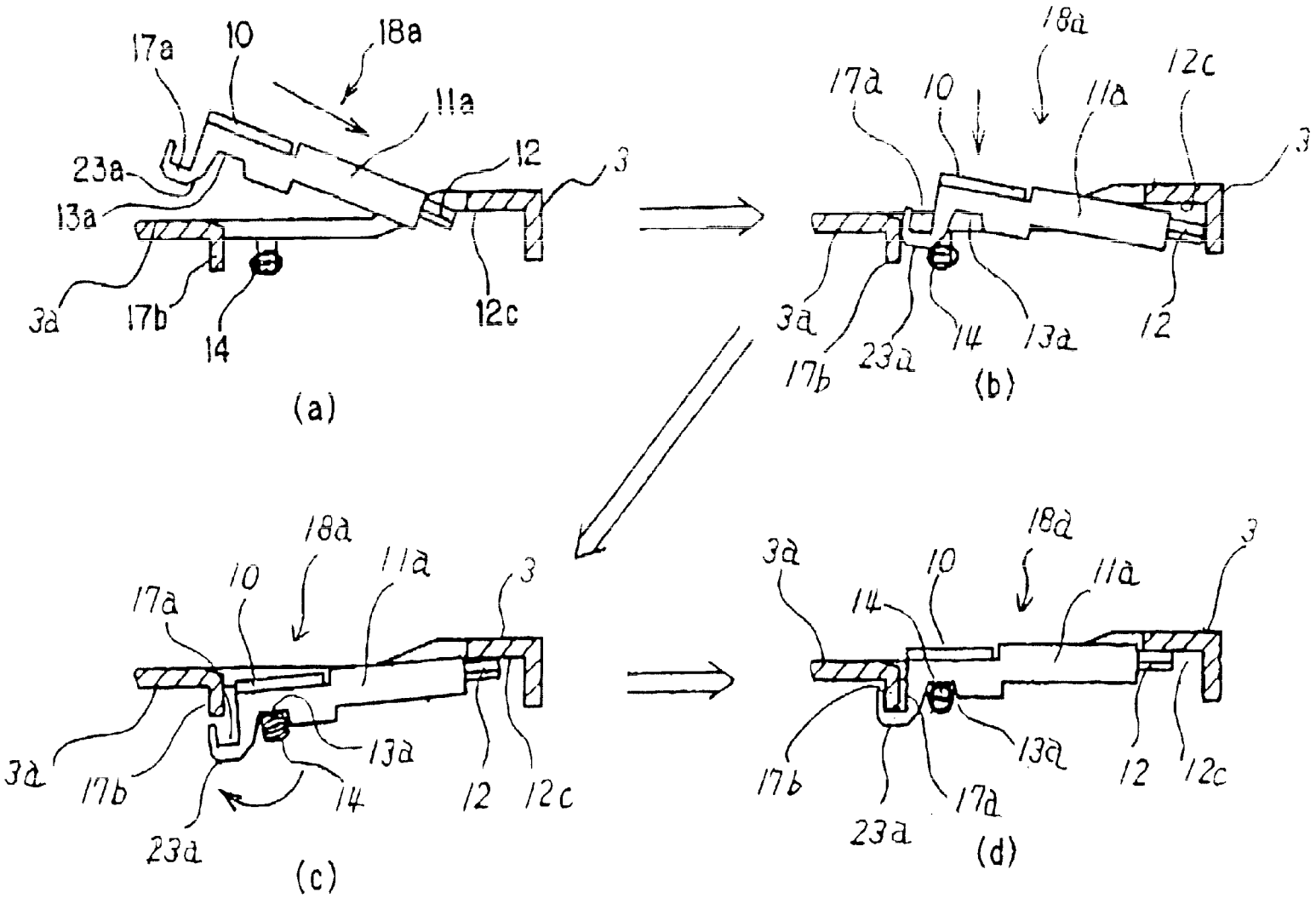
FIG. 6 is explanatory views showing operations for attaching separating means in accordance with the second embodiment.

(1) Slide the separating pad unit 18*a* to the upstream side in the conveying direction in a state in which the upstream side in the conveying direction of the separating pad unit 18*a* is slanted downward from the side on which the sheet feeding roller 6 is disposed and insert the rotational fulcrum shaped portion 12 into a rotational fulcrum portion (back ceiling surface) 12*c* as an insertion guide provided on the upstream side of the opening 16, and then drop the separating pad unit 18*a* into the opening 16 (FIG. 6(*a*)) and (2) slide the separating pad unit 18*a* in the conveying direction while pressing the tip on the downstream side in the conveying direction of the pad holder 11*a* in a direction opposite to the pressuring direction of the pressuring means 14 and insert the rotation regulating recessed shaped portion 17*a* in the rotation regulating protruded shaped portion 17*b* to fit the recess and the protrusion (FIGS. 6(*b*) to 6(*c*)), (3) then, the coil spring 14 surmounts the slanted surface 23 while the pad holder 11*a* receiving a repulsion of the coil spring 14 and the pad holder 11*a* is disposed in a waiting position (FIG. 6(*d*)).

In order to remove the separating means, it is sufficient to perform opposite operations.

When the rotation regulating recessed shaped portion 17*a* is removed from the rotation regulating protruded shaped portion 17*b,* the separating pad unit 18*a* is lifted from the conveying surface 3*a* by the repulsion generated when the coil spring 14 surmounts the slanted surface 23*a,* whereby the separating pad unit 18*a* can be removed from the conveying surface 3*a* easily.

As described above, according to this embodiment, since the separating pad unit 18 was attachably detachable from a sheet conveying surface side in two actions, insertion of the separating pad unit 18*a* could be performed easily and operability was successfully improved. That is, the pad holder 11*a* being a holding member forming the separating pad unit 18*a,* a structure for supporting the pad holder 11*a* in a housing and a shape of the housing for supporting the pad holder 11*a* was simply changed slightly from a conventional configuration, whereby usability was successfully improved without increasing the number of components.

Moreover, since replaceability of the separating pad unit 18*a* that has ended its durable life was improved, disassembling performance as good as that of new one was able to be easily provided and it became possible to stabilize sheet feeding performance at low costs.

Although the opening 16 of the conveying frame 3 is provided in the central part of the conveying frame in this embodiment, a position of an opening is not limited to a central part in the case in which the arrangement of the sheet feeding roller 6 and the separating pad 10 is not in a center of a reader frame such as the case of a one side standard configuration.

In addition, although one rotational shaft fulcrum shaped portion 12*a* and one rotation regulating recessed shaped portion 17*a* are disposed in this embodiment, it is sufficient that two or more of them are disposed as long as they have a configuration for regulating a rotating motion or a rotational fulcrum.

Further, the present invention is not limited to the above-mentioned embodiment and, for example, the separating pad may be a fixed roller or a retard roller. In addition, the conveying roller and the sheet feeding roller may be other rotating bodies such as a belt. In addition, the present invention can be applied to an image forming apparatus such as a copying machine and a printer other than the image reading apparatus.

Moreover, the positional relation between the sheet feeding roller 6 to be sheet feeding means and the separating pad unit 18*a* to be separating means may be reversed.

That is, the sheet feeding roller 6 may be disposed in a conveying frame on a fixed side and the separating pad unit 18*a* may be disposed in the upper guide frame 2 on a movable side.

Third Embodiment

Figure 7:
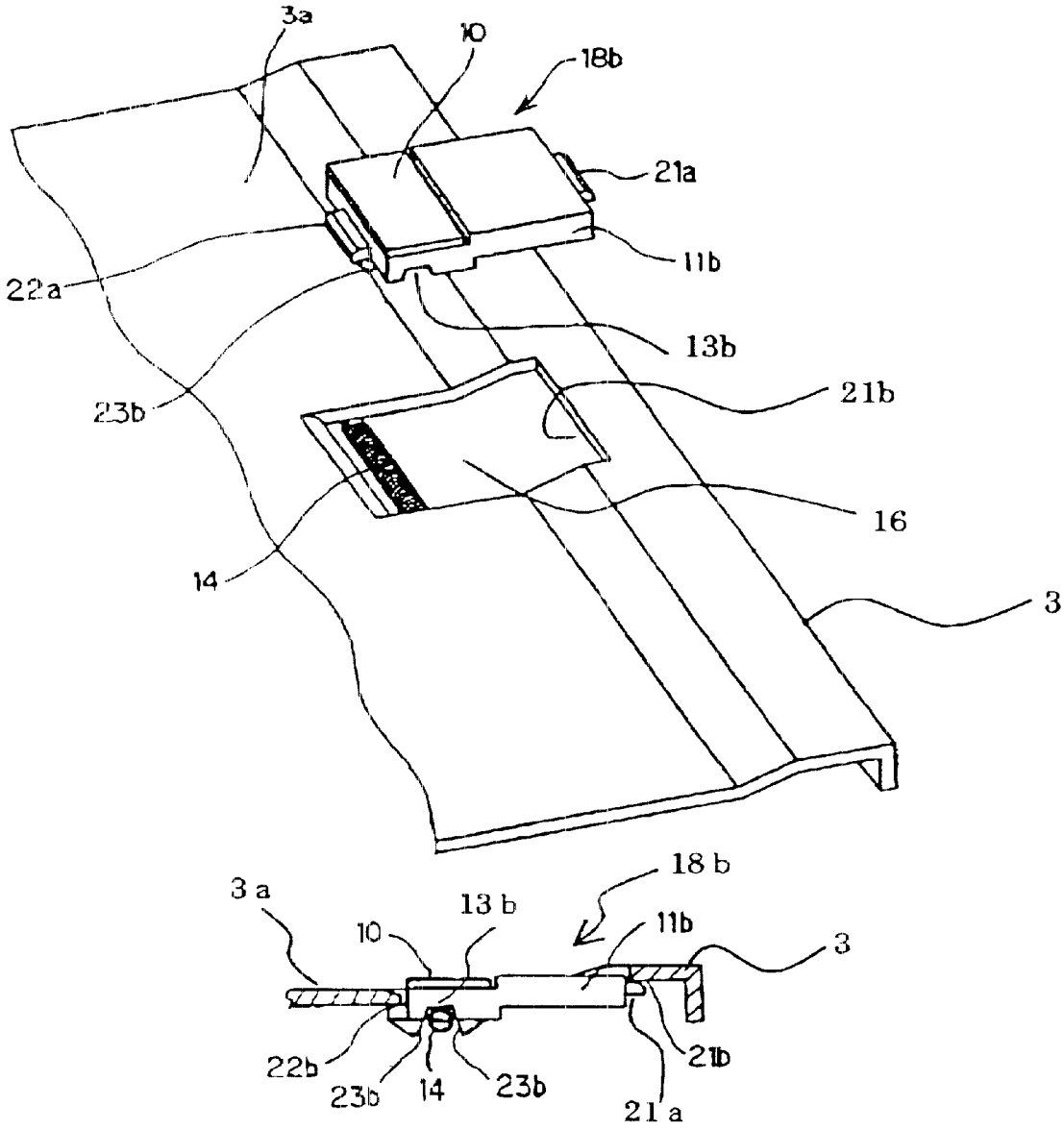
FIG. 7 is detailed explanatory views of a main part of a sheet feeding apparatus in accordance with a third embodiment.
Figure 8:
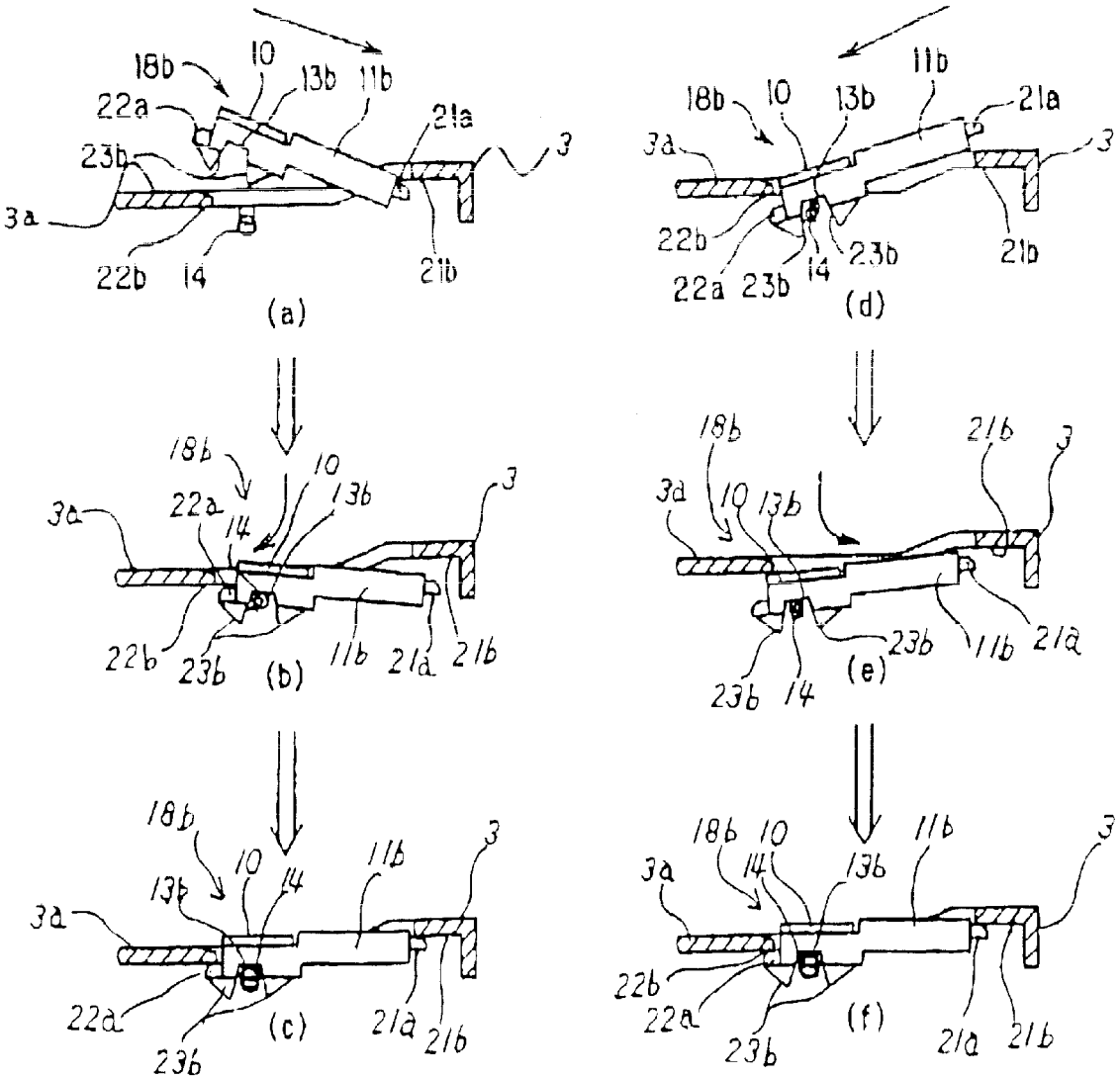
FIG. 8 is explanatory views showing operations for attaching separating means in accordance with the third embodiment.
Figure 9:
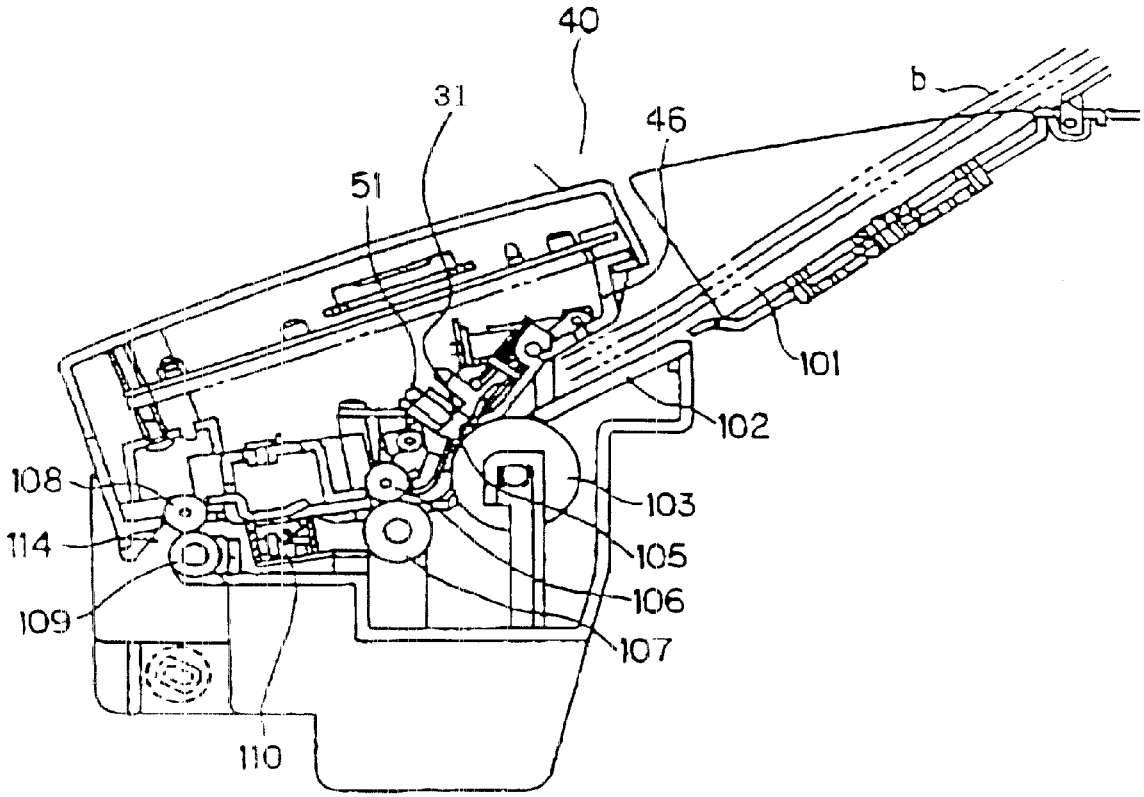
FIG. 9 is a schematic sectional view of a conventional image reading apparatus.
Figure 10:
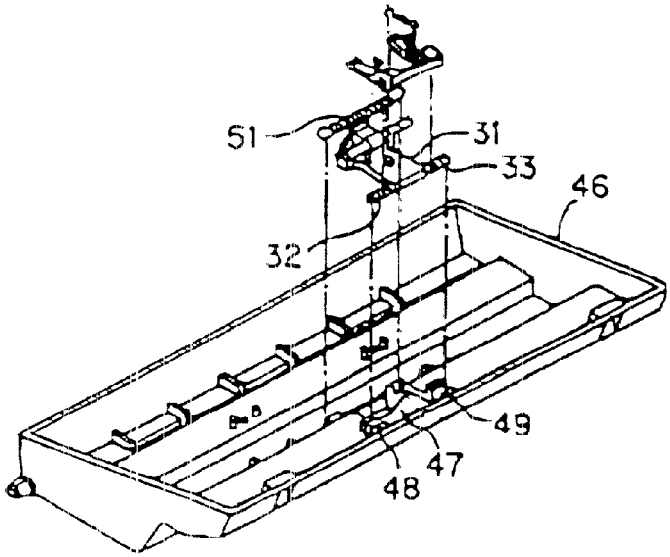
FIG. 10 is explanatory views showing operations for attaching conventional separating means.
Figure 10:
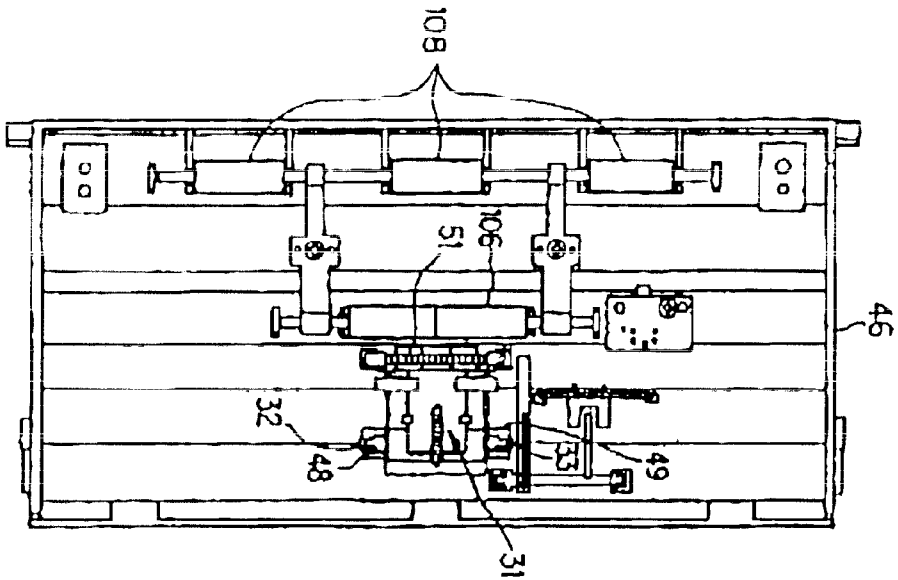

FIGS. 7 and 8 show a third embodiment of the present invention. Further, like reference numerals are assigned to components that are similar to or the same as those in the above-mentioned embodiments and description of them is omitted. A characteristic configuration of this embodiment will be hereinafter described.

A separating pad unit 18*b* has a rotational fulcrum shaped portion 21*a* for forming a rotational center of a pad holder 11*b* on the upstream side in a conveying direction of the pad holder 11*b* in a conveying direction, has a rotation regulating shaped portion 22*a* as a portion to be regulated for regulating a rotating motion on the downstream side in the conveying direction of the pad holder 11*b* in the conveying direction, and has a pressuring means receiving portion 13*b* for receiving a pressure from the pressuring means 14 in a fixed direction on the back side of the side on which the separating pad 10 is disposed in the end in the downstream part in the conveying direction of the pad holder 11*b*.

In addition, a gently slanted pressuring means insertion guide shaped portion (slanted surfaces 23*b,* 23*b*) is provided on both the upstream and the downstream sides in the conveying direction of the pressuring means receiving portion 13*b*.

The separating pad unit 18*b* is embedded in the central part of the conveying surface of the conveying frame 3 located on a side opposing the sheet feeding roller 6.

An opening 16 for housing the separating pad unit 18*b* is provided in the central part of the conveying surface of the conveying frame 3. In addition, the coil spring 14 being the pressuring means of the pad holder 11*b* is disposed and configured in a bridge shape in the downstream part in the conveying direction of the opening 16 of the conveying frame 3. Thus, the miniaturization (thickness reduction) of the apparatus is readily realized.

The separating pad unit 18*b* is pressed downward at the time of original separation Then, the pressuring means receiving portion 13*b* of the pad holder 11*b* is pressed by the coil spring 14, whereby the separating pad unit 18*b* performs a rotating motion with an arbitrary point of the rotational fulcrum shaped portion 21*a* as a fulcrum, whereby the separating pad 10 is brought to be in pressured contact with the sheet feeding roller 6.

In addition, although the separating pad unit 18*b* is always pressed to the conveying surface by the coil spring 14 also at the time when a nip is opened, the rotation regulating shaped portion 22*a* collides with a back ceiling surface 22*b* on the downstream of the conveying frame opening as the position regulating portion, whereby the separating pad unit 18*b* does not get through to the conveying surface in a stationary position.

Next, a configuration for attaching the separating pad unit 18*b* to the conveying frame 3 will be described with reference to FIG. 8.

The conveying frame 3 to which the separating pad unit 18*b* is attached and the upper original guide 2 to which the sheet feeding roller 6 is attached are combined, whereby the nip between the separating pad 10 and the sheet feeding roller 6 can be opened in dealing with paper jamming or the like.

When the upper original guide 2 is opened and the nip position is opened, a conveying surface 3*a* and the conveying surface opening 16 can be seen.

(1) Slide the separating pad unit 18*b* to the upstream side in the conveying direction in a state in which the upstream side in the conveying direction of the separating pad unit 18*a* is slanted downward from the side on which the sheet feeding roller 6 is disposed and insert the rotational fulcrum shaped portion 21*a* into the back ceiling surface 21*b* as the inserting guide on the upstream side of the opening 16, and then drop the separating pad unit 18*b* into the opening 16 (FIG. 8(*a*)) and (2) slide the separating pad unit 18*b* in the conveying direction while pressing the tip on the downstream side in the conveying direction of the pad holder 11*b* in a direction opposite to the pressuring direction of the coil spring 14 (FIG. 8(*b*)), (3) then, the coil spring 14 surmounts the slanted surface 23*b* while the pad holder 11*b* receiving a repulsion of the coil spring 14 and the pad holder 11*b* is disposed in a waiting position (FIG. 8(*c*)).

In order to remove the separating means, it is sufficient to perform opposite operations.

When the rotational fulcrum shaped portion 21*a* is removed from the back ceiling surf ace 21*b* of the opening by sliding the separating pad unit 18*b* to the upstream in the conveying direction, the separating pad unit 18*b* is lifted from the conveying surface 3*a* by the repulsion generated when the coil spring 14 surmounts the slanted surface 23*b*, whereby the separating pad unit 18*b* can be removed from the conveying surface 3*a* easily (FIGS. 8(*c*) to 8(*a*)).

In addition, in this embodiment, the separating pad unit 18*b* can also be attached easily by dropping the separating pad unit 18*b* from the downstream side in the conveying direction and sliding it (FIGS. 8(*d*) to 8(*f*)).

As described above, according to this embodiment, since the separating pad unit 18*b* was attachably detachable from a sheet conveying surface side in two actions, insertion of the separating pad unit 18*b* could be performed easily and operability was successfully improved. That is, the pad holder 11*b* being a holding member forming the separating pad unit 18*b*, a structure for supporting the pad holder 11*b* in a housing and a shape of the housing for supporting the pad holder 11*b* was simply changed slightly from a conventional configuration, whereby usability was successfully improved without increasing the number of components.

Moreover, since replaceability of the separating pad unit 18*b* that has ended its durable life was improved, disassembling performance as good as that of new one was able to be easily provided and it became possible to stabilize sheet feeding performance at low costs.

Although the opening 16 of the conveying frame 3 is provided in the central part of the conveying frame in this embodiment, a position of an opening is not limited to a central part in the case in which the arrangement of the sheet feeding roller 6 and the separating pad 10 is not in a center of a reader frame such as the case of a one side standard configuration.

In addition, although one rotational shaft fulcrum shaped portion 21*a* and one rotation regulating recessed shaped portion 22*a* are disposed in this embodiment, it is sufficient that two or more of them are disposed as long as they have a configuration for regulating a rotating motion or a rotational fulcrum.

Further, the present invention is not limited to the above-mentioned embodiment and, for example, the separating pad may be a fixed roller or a retard roller. In addition, the conveying roller and the sheet feeding roller may be other rotating bodies such as a belt. In addition, the present invention can be applied to an image forming apparatus such as a copying machine and a printer other than the image reading apparatus.

Moreover, the positional relation between the sheet feeding roller 6 to be sheet feeding means and the separating pad unit 18*b* to be separating means may be reversed.

That is, the sheet feeding roller 6 maybe disposed in a conveying frame on a fixed side and the separating pad unit 18*b* may be disposed in the upper guide frame 2 on a movable side.

Various embodiments have been described. Moreover, the above-mentioned image reading apparatus may be in the form of a copying apparatus in addition to that used as image input/output terminal of information processing equipment such as a computer.

As described above, according to the present invention, an inserting guide for guiding insertion of a separating unit into an opening from a sheet conveying rotating member side and a position regulating portion for regulating a portion to be regulated provided in the separating unit and guided by the inserting guide to be inserted in the opening and locating the separating unit in a position in the opening where it should be accommodated are provided in an edge area of the opening, whereby the separating unit can be attached and detached from the sheet conveying rotational member side easily. Thus, it becomes possible to realize improvement of usability.

Moreover, since replaceability of a frictional member that has ended a durable life is improved, it becomes possible to easily provide disassembling performance equivalent to that of new one. Therefore, sheet feeding performance can be stabilized and improved.

What is claimed is:

1. A sheet feeding apparatus, comprising:

a sheet conveying rotational member for feeding sheets;

a separating unit, having a frictional member abutting said sheet conveying rotational member to form a nip portion, for separating sheets one by one by said nip portion;

a frame body having an opening in which said separating unit is accommodated and holding said separating unit;

an insertion guide provided in an edge area of said opening and guiding insertion of said separating unit into said opening from said sheet conveying rotational member side; and a position regulating portion provided in said edge area of said opening and regulating a portion to be regulated, which is provided in said separating unit guided by said insertion guide to be inserted in said opening, to locate said separating unit in a position inside said opening where said separating unit should be accommodated.

2. A sheet feeding apparatus according to claim 1, further comprising pressuring means for pressuring said separating unit to cause said frictional member to pressure said sheet conveying rotational member is provided in said frame body.

3. A sheet feeding apparatus according to claim 2, wherein said pressuring means is a coil spring provided to traverse said opening of said frame body and energizes said separating unit accommodated in said opening from the rear surface side.

4. A sheet feeding apparatus according to claim 2, wherein said separating unit is provided with a receiving portion that is pressured by said pressuring means on the surface side not opposing to said sheet conveying rotational member, and wherein a slanted shaped portion slanting to said receiving portion in order to guide said pressuring means to said receiving portion is provided on at least one of the upstream and the downstream sides in the sheet conveying direction of said receiving portion.

5. A sheet feeding apparatus according to claim 4, wherein said separating unit to be inserted in said opening is guided by said insertion guide and is then inserted against an energizing force generated by said slanted shaped portion and said receiving portion following the movement of said pressuring means to be located in a position in the opening where said separating unit should be accommodated by said position regulating portion.

6. A sheet feeding apparatus according to claim 5, wherein said position regulating portion regulates said portion to be regulated in a movable area of said separating unit to be pressured by said pressuring means.

7. A sheet feeding apparatus according to claim 1 further comprising opening means for opening said nip portion to separate an apparatus main body into a movable housing for performing an opening motion and a fixed housing, wherein said separating unit is provided in one of said movable housing and said fixed housing.

8. A sheet feeding apparatus according to claim 1, wherein said separating unit is provided with a rotational shaft for being rotatably supported in said opening and a rotation regulating fit portion to be inserted in a rotation regulating groove provided in a position regulating portion for regulating rotation, and wherein said rotational shaft is inserted in said insertion guide and then said rotation regulating fit portion is inserted in said rotation regulating groove, whereby said separating unit is accommodated in said opening.

9. A sheet feeding apparatus according to claim 8, wherein said rotational shaft is also received on one end side of said separating unit and said rotation regulating fit portion is provided in both side portions of said separating unit.

10. A sheet feeding apparatus according to claim 1, wherein said separating unit is provided with a rotational fulcrum shaped portion for being rotatably supported in said opening and a rotation regulating recessed shaped portion for fitting with a rotation regulating protruded shaped portion provided in a position regulating portion for regulation rotation, and wherein said rotational fulcrum shaped portion is inserted in a rotational fulcrum hole of said insertion guide and then said rotation regulating recessed shaped portion and said rotation regulating protruded shaped portion are fitted, whereby said separating unit is accommodated in said opening.

11. A sheet feeding apparatus according to claim 10, wherein said rotational fulcrum shaped portion is provided on one end side of said separating unit and said rotation regulating recessed shaped portion is provided on the other end side.

12. A sheet processing apparatus comprising:

a sheet feeding apparatus that comprises:

a sheet conveying rotational member for feeding sheets;

a separating unit, having a frictional member abutting said sheet conveying rotational member to form a nip portion, for separating the sheets one by one by said nip portion;

a frame body having an opening in which said separating unit is accommodated and holding said separating unit;

an insertion guide provided in an edge area of said opening and guiding insertion of said separating unit into said opening from said sheet conveying rotational member side;

a position regulating portion provided in said edge area of said opening and regulating a portion to be regulated, which is provided in said separating unit guided by said insertion guide to be inserted in said opening, to locate said separating unit in a position inside said opening where said separating unit should be accommodated; and at least one of image forming means for forming an image on a sheet fed by said sheet feeding apparatus and image reading means for reading image information of said sheet.

13. A sheet processing apparatus according to claim 12, wherein said sheet feeding apparatus is provided with pressuring means for pressuring said separating unit to cause said frictional member to pressure said sheet conveying rotational member;

wherein said separating unit is provided with a receiving portion to be pressured by said pressuring means to the surface side not opposing to said sheet conveying rotational member; and wherein a slanted shaped portion slanted with respect to said receiving portion is provided on at least one of the upstream or downstream sides of the sheet conveying direction of said receiving portion.

* * * * *